US005655503A

United States Patent [19]

Kampichler et al.

[11] Patent Number: 5,655,503

[45] Date of Patent: Aug. 12, 1997

[54] INTERNAL COMBUSTION ENGINE WITH FUEL INJECTION, PARTICULARLY, A SINGLE-CYLINDER DIESEL ENGINE

[75] Inventors: Gunter Kampichler; Herbert Geier, both of Ruhstorf/Rott, Germany

[73] Assignee: Motorenfabrik Hatz GmbH & Co., KG., Ruhstorf/Tott, Germany

[21] Appl. No.: 643,843

[22] Filed: May 7, 1996

Related U.S. Application Data

[63] Continuation of Ser. No. 524,451, Sep. 6, 1995, abandoned.

[30] Foreign Application Priority Data

Mar. 11, 1993 [DE] Germany ..... 43 07 651.6

[51] Int. Cl.[6] ..... F02M 37/04; F04B 39/10

[52] U.S. Cl. ..... 123/510; 417/571

[58] Field of Search ..... 123/510; 137/539; 417/571

[56] References Cited

U.S. PATENT DOCUMENTS

| | | | |
|---|---|---|---|
| 4,006,797 | 2/1977 | Keske | 417/471 |
| 4,099,597 | 7/1978 | Powel et al. | 417/471 |
| 4,168,687 | 9/1979 | Kurahashi et al. | 123/510 |
| 4,212,316 | 7/1980 | Basch et al. | 417/471 |

*Primary Examiner*—Thomas N. Moulis
*Attorney, Agent, or Firm*—Helfgott & Karas PC.

[57] ABSTRACT

The invention concerns an internal-combustion engine with fuel injection, in particular a single-cylinder diesel engine, in which the fuel-injection pump (3) is connected to the fuel pressure line (23) by a constant-pressure valve assembly comprising a feed valve (28) and a pressure-relief valve (29) mounted with its direction of flow opposite to the feed direction. Both valves (28, 29) are fitted next to each other and off the cylinder axis in a separate valve housing located directly on top of the pump cylinder (5).

6 Claims, 2 Drawing Sheets

Figure 1:
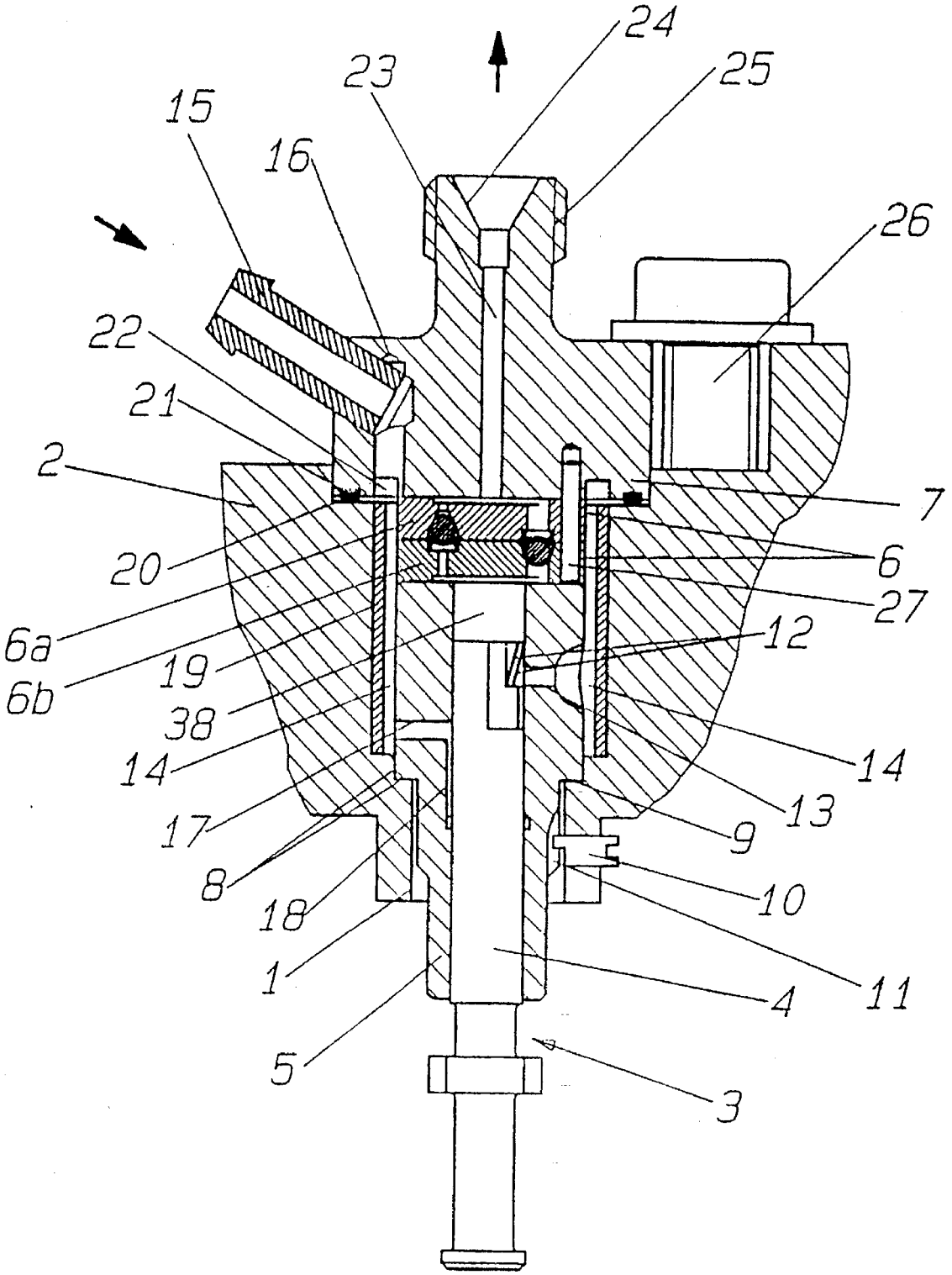

INTERNAL COMBUSTION ENGINE WITH FUEL INJECTION, PARTICULARLY, A SINGLE-CYLINDER DIESEL ENGINE

This is a continuation of application Ser. No. 08/524,451, filed Sep. 6, 1995, now abandoned, which is a continuation of PCT/EP94/00753, filed Mar. 10, 1994.

The invention relates to an internal combustion engine with fuel injection as defined in the introductory portion of claim 1.

In the case of diesel engines, an accurately metered mount must be injected at high pressure into the combustion space of the engine. Dead space in the line connecting the injection pump and the injection nozzle make it difficult to optimize the start of the combustion. To compensate for this dead space, additional measures, such as an injection adjuster, which advances the start of the pumping as the rpm increases, must be provided. If the injection pump and the injection nozzle are separated spatially, delays due to pressure wave running times can also be compensated for by these means at the same time.

The amount of fuel is controlled as a function of the load and the rpm by means of a control device on the injection pump. It has turned out that it is difficult to control the effect of dead space in such a system since, as a result of the high pressures, under which the fuel no longer is incompressible, the processes during the injection proceed dynamically. On the basis of these considerations, balanced pressure valve devices were developed with the objective of compensating for interfering pressure fluctuations in the line system. In this connection, attention must be paid to minimizing the proportion of dead space in the line system, for example, by placing the injection pump as close as possible to the injection nozzle or by avoiding structurally produced dead spaces as far as possible.

In the case of a known injection pump (DE-A-34 24 401) for a fuel injection installation without overflow oil line, a balanced pressure valve device is provided, for which delivery is accomplished over a discharge valve of large cross section and the pressure on the line is relieved over a pressure relief valve with an opposite direction of flow and a small throttling port; both valves are constructed as check valves with valve bodies as balls and with valve springs as helical springs. The valves are disposed in the manner mentioned above next to one another in blind boreholes of the valve housing, which are connected over further boreholes with the corresponding connecting spaces. This construction requires a valve housing of appreciable axial length and correspondingly large interfering dead spaces result.

A different, known injection pump (DE-A-2217066) has a balanced pressure valve, the relief valve of which is connected over a groove, on the one hand, with the pressure valve and, on the other, with a funnel-shaped expansion of the fuel pressure line. By these means, while putting up with corresponding dead spaces, a reflection of the pressure waves, which return from the injection valve and lead to undesirable post-injection of the injection valve, are to be avoided.

Pursuant to the present invention, the disadvantage of the known injection pumps with balanced pressure valve devices are to be avoided; at the same time, the construction of the injection pump of the generic engine is to be simplified particularly with respect to the balanced pressure valve device.

Pursuant to the invention, this objective is accomplished owing to the fact that the valve housing, at its opposite front ends, has transverse grooves, over which the valve boreholes of the valve housing, in each case accommodating one of the two valves, are connected with one another and which, on the one hand, adjoin the working space of the injection pump and, on the other, the fuel pressure line and owing to the fact that the valve springs are leaf springs, which in each case are located in a chamber of the valve housing, through which there is corresponding flow.

As a result of the arrangement of the opposite transverse grooves of the valve housing, it is possible to reduce clearly the axial length of the balanced pressure valve device; in addition, the manufacture and installation of the injection device is simplified considerably by such a valve housing.

It has proven to be particularly advantageous that the valve bodies, in proven manner, have balls or spherical surfaces, which press against or with which they are pressed by valve springs against conical valve seats, and that the valve springs are constructed as leaf springs, which in each case are located in a chamber of the valve housing, through which there is corresponding flow. Advantageously, the two chambers are in each case open towards a common dividing joint of two valve housing parts, the valve seat, corresponding to the respective chamber, being disposed in each case in the other valve housing part, with a conical angle opening out towards the dividing joint. Accordingly, for this construction, the valve housing is divided into two and is thus manufactured more easily. The conical angle of the valve seat preferably is 60°. From a flow technology point of view, this conical angle is superior to the usually larger conical angles.

Advisably, the two ends of the leaf springs are supported so that they can slide against the rear wall of the associated chamber, which can, moreover, be provided with a gliding layer.

An optimum utilization of space with minimum dead spaces and, at the same time, a particularly flat construction of the valve housing part is achieved owing to the fact that the leaf springs, when the valve is closed, are in contact with the associated valve body approximately at the level of the dividing joint.

Since the injection pump is seated directly in the wall of the crankcase, which consists, for example, of east aluminum, it is advisable to protect this housing against turning-on impulses of the pump by impact protection in the form of a jacket of hardened steel. The jacket sits in a borehole surrounding the injection pump and forms the boundary of an inlet chamber, which is acted upon by the fuel pump.

Figure 4:
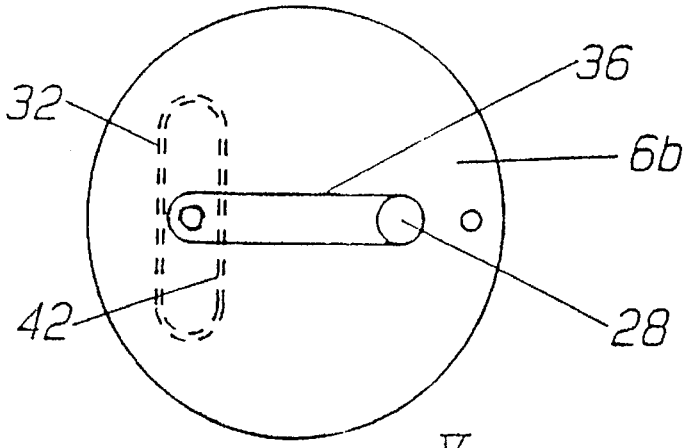
Figure 2:
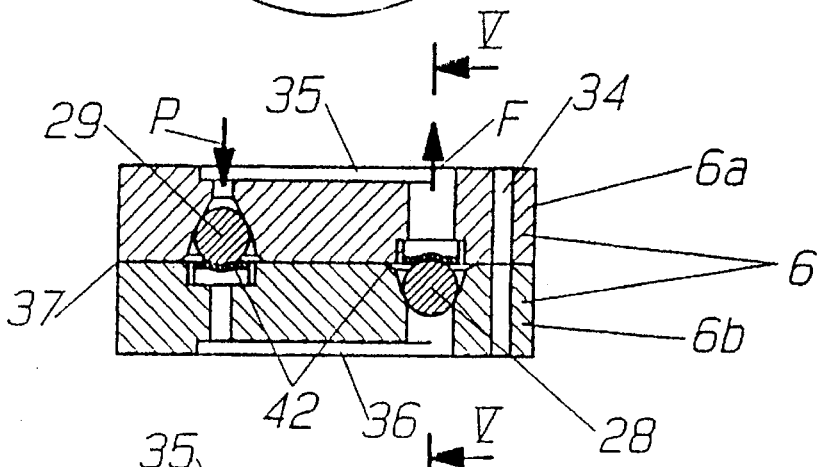
Figure 3:
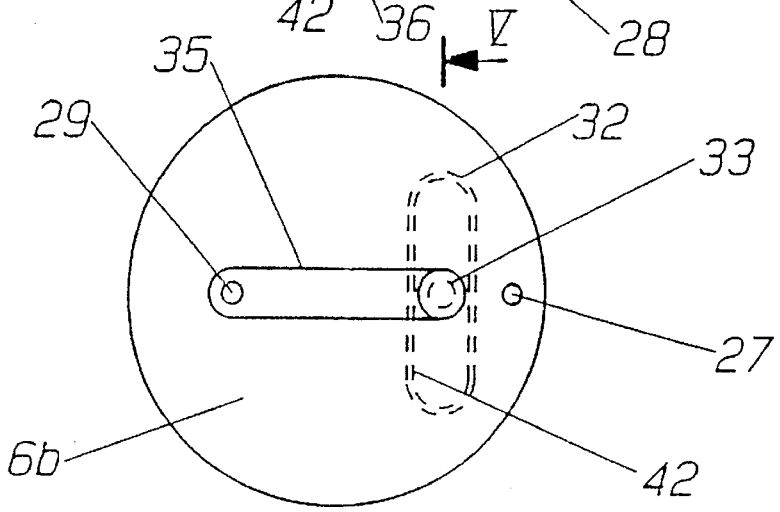
Figure 5:
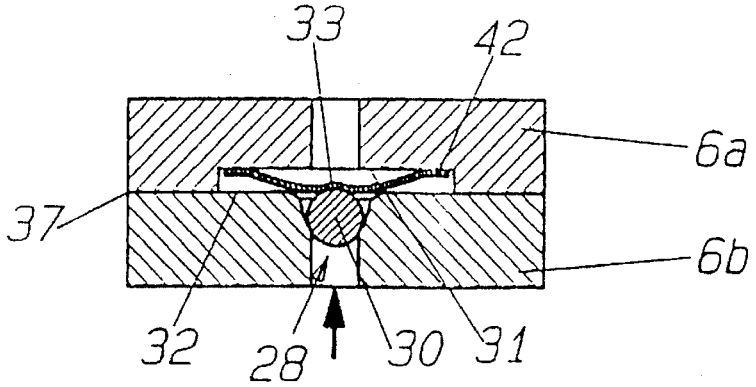

Further details and advantages of can be inferred from the following description by means of the examples. In the drawing FIG. 1 shows an axial section through a first embodiment of the injection pump, FIG. 2 shows an axial section through the valve housing of FIG. 1 on an enlarged scale, FIG. 3 shows a plan view of the valve housing of FIG. 2, FIG. 4 shows a view of the valve housing of FIG. 2 from below and FIG. 5 shows a section through the valve housing along line V—V of FIG. 3.

FIG. 1 is a sectional view of the part of an injection pump 3, which is seated in a borehole 1 of wall 2 of the crankcase of a diesel engine and consists essentially of a pump piston 4, a pump cylinder 5 and a balanced pressure valve device with a valve housing 6. These components are tied down by means of a valve holder 7 against a seat 8 of the housing borehole 1, an appropriate shoulder 9 of the pump piston 5

(???, sic!) engaging the seat 8. By means of a pin 10, the inner end of which enters a groove 11 of the pump cylinder 5, the latter is secured against twisting. The pump piston 4 is constructed in the usual manner, that is, it has a control groove 12, which acts in concert with a first inlet borehole 13 in the pump cylinder 5, which is supplied from the outside over an annular inlet chamber 14. Fuel is supplied to the inlet chamber 14 by means of a fuel line (not shown), which supplies the inlet chamber 14 over a connecting piece 15 and a connecting borehole 16, which is connected with the connecting piece 15 and with the inlet chamber 14. A further inlet borehole 17, together with an overflow groove 18 is in the pump cylinder 5 on the side opposite to that of the first borehole 13; the second inlet borehole 17 is also connected with the inlet space 14, which is bounded towards the outside by a jacket 19 of hardened steel, which forms the outside boundary of the inlet space 14 and protects the housing wall 2, which usually consists of east aluminum against the turning-on impulse of the pump piston 4. The jacket 19 is closed off flush at the top by a sealing surface 20, which is countersunk into the housing wall 2 and sealed by means of a ring seal 21 from the valve holder 7. An annular groove 22 on the underside of the valve holder 7, which intersects the connecting borehole 16, ensures that the inlet space 14 is filled with fuel. In the center of the valve holder 7, there is a fuel pressure line 23, which is intended to be connected with the injection line (not shown) and discharges with a connecting cone 24 into a fitting 25 of the valve holder 7. The valve holder 7 is held down by several tightening screws 26 against the upper end face of the valve housing 6. A centering pin 27 ensures that an upper part **6*a* and a lower part 6*b* of the valve housing 6 are aligned accurately with respect to the valve holder 7. The valve housing 6 is shown on a larger scale in FIG. 2. It encloses the actual balanced pressure valve device, consisting of two cheek valves, namely a discharge valve 28 and a pressure relief valve 29, the borehole of the latter being significantly smaller than that of the discharge valve 28. Both valves have balls 30 as valve bodies, which in each ease are accommodated in a conical valve seat, the conical angle of which is 60°. Both balls are put under tension by means of leaf springs 42, one of which is shown in the side view of FIG. 5. The leaf springs 42 are appropriately arched and supported with their opposite ends against the rear wall 31 of a flat chamber 32, in which they are accommodated, so that they can slide; in the center, the leaf springs 42 have a slight indentation 33, which serves as a supporting surface for the balls 30 forming the valve body. To promote the valve function, it may be appropriate to provide the rear wall 31 with a sliding layer to avoid abrasion between the rear wall and the ends of the leaf springs 42. Flow through the discharge valve is in the direction of arrow F and through the pressure relief valve in the opposite direction indicated by arrow P. Accordingly, the outlet of the discharge valve 28 is connected over a transverse groove 35 with the inlet of the pressure relief valve 29; moreover, the inlet of the discharge valve 28 is connected over an appropriate transverse groove 36 with the outlet of the pressure relief valve 29**.

The valve housing is composed of an upper valve housing part **6*a* and a lower valve housing part 6*b*, the latter adjoining the pump cylinder 5 and the former the valve holder 7. The two valve housing parts 6*a*, 6*b* form a common dividing joint 37, which adjoins the conical valve seats and the chambers 32, in which the leaf springs 42** are accommodated.

The transverse groove 35 in the upper part **6*a* of the valve housing 6 is connected in a liquid-conducting manner with the fuel pressure line 23 in the valve holder 7. The transverse groove 36 in the lower part 6*b* of the valve housing 6 is connected in a liquid-conducting manner with the working space 38 of the injection pump. A borehole 34 serves to accommodate the centering pin 27**.

We claim:

1. An internal combustion engine with fuel injection, particularly a one-cylinder diesel engine, for which the working space (38) of the injection pump (3) is connected over a balanced pressure valve device with a discharge valve (28) and a pressure relief valve (29), through which flow takes place in the opposite direction, with a fuel pressure line (23), both valves (28, 29) being disposed in a valve housing (6) eccentrically next to one another with respect to the axis of the pump cylinder (5) and the valve bodies of the valves (28, 29) being balls (30), or having spherical surfaces, which are pressed or with which they are pressed by means of valve springs against conical valve seats, characterized in that the valve housing (6) has transverse grooves (35, 36) at its opposite end faces, over which the valve boreholes of the valve housing (6), in each case accommodating one of the two valves (28, 29) are connected with one another and which, on the one hand, adjoin the working space (38) of the injection pump (3) and, on the other, the fuel pressure line (23), and in that the valve springs are leaf springs (42), which in each case are seated in a chamber (32) of the valve housing (6), through which there is appropriate flow.

2. The internal combustion engine of claim 1, characterized in that the two chambers (32) in each case are open towards a common dividing joint (37) of two parts (**6*a*, 6*b*) of the valve housing (6**).

3. The internal combustion engine of claim 2, characterized in that the valve seat, corresponding to the respective chamber (32) of a valve housing part (**6*a*, 6*b*) is disposed in each case in the other valve housing part (6*b*, 6*a*) with a conical angle opening up towards the dividing joint (37**).

4. The internal combustion engine of claim 1, characterized in that the two ends of the leaf springs (42) are supported in each case so that they can slide against the rear wall (31) of the associated chamber (32).

5. The internal combustion engine of claim 4, characterized in that the rear wall (31) is provided with a sliding layer.

6. The internal combustion engine of claim 2, characterized in that the leaf springs (42), when the valve is closed, are in contact with the associated valve body approximately at the level of the dividing joint (37).

* * * * *